US009258636B2

(12) United States Patent
Nakano et al.

(10) Patent No.: US 9,258,636 B2
(45) Date of Patent: Feb. 9, 2016

(54) HEADPHONE SET

(71) Applicant: Panasonic Intellectual Property Management Co., Ltd., Osaka (JP)

(72) Inventors: Masahiro Nakano, Osaka (JP); Mikiyasu Ishikura, Osaka (JP); Yusaku Shimaoka, Osaka (JP); Hitoshi Nakagawa, Osaka (JP); Tetsuya Kaneshiro, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/645,200

(22) Filed: Mar. 11, 2015

(65) Prior Publication Data

US 2015/0189422 A1 Jul. 2, 2015

Related U.S. Application Data

(63) Continuation of application No. PCT/JP2014/003980, filed on Jul. 30, 2014.

(30) Foreign Application Priority Data

Dec. 25, 2013 (JP) ..... 2013-267111

(51) Int. Cl.
*H04R 1/10* (2006.01)

(52) U.S. Cl.
CPC ..... *H04R 1/1058* (2013.01); *H04R 1/105* (2013.01); *H04R 1/1066* (2013.01); *H04R 1/1008* (2013.01)

(58) Field of Classification Search
CPC .... H04R 1/10; H04R 2205/022; H04R 1/105; H04R 5/0335; H04R 2201/10
USPC ..... 381/370–371, 374, 377–379, 383
See application file for complete search history.

(56) References Cited

U.S. PATENT DOCUMENTS

| | | | | |
|---|---|---|---|---|
| 1,087,704 | A * | 2/1914 | Adams Randall | 381/378 |
| 2,686,231 | A * | 8/1954 | Stevens | 381/378 |
| 3,984,885 | A * | 10/1976 | Yoshimura et al. | 381/378 |

(Continued)

FOREIGN PATENT DOCUMENTS

| | | | |
|---|---|---|---|
| JP | 59-101586 | U | 7/1984 |
| JP | 08-009490 | A | 1/1996 |
| JP | 10-145885 | A | 5/1998 |
| JP | 2008-147744 | A | 6/2008 |
| JP | 2012-186660 | A | 9/2012 |

OTHER PUBLICATIONS

International Search Report issued in International Application No. PCT/JP2014/003980 dated Sep. 9, 2014.

*Primary Examiner* — Suhan Ni
(74) *Attorney, Agent, or Firm* — McDermott Will & Emery LLP

(57) ABSTRACT

In a conventional headphone set, there is a possibility that a headband cannot be put in a suitable position when an ear pad is snugly mounted on an ear. A headphone set of this disclosure includes speaker units which output a sound. The headphone set also includes: speaker housings which are brought into contact with a user; connecting portions which are connected to the speaker housings in a state where the speaker housings are movable in a forward and rearward direction of the user; and a headband which has connecting portions on end portions thereof and is mounted on a head of the user in directions toward a crown of the head of the user. Due to such a constitution, the headphone set can be used in a more stable manner.

7 Claims, 22 Drawing Sheets

(56) References Cited

U.S. PATENT DOCUMENTS 5,185,807 A * 2/1993 Bergin et al. ..... 381/378
5,696,831 A 12/1997 Inanaga et al.
6,081,604 A * 6/2000 Hikichi et al. ..... 381/378
6,295,366 B1 * 9/2001 Haller et al. ..... 381/378
8,249,267 B2 * 8/2012 Leske et al. ..... 381/378
8,737,668 B1 * 5/2014 Blair et al. ..... 381/378
2013/0335536 A1 12/2013 Kura et al.

* cited by examiner

HEADPHONE SET

RELATED APPLICATIONS

This application is a continuation of International Application No. PCT/JP2014/003980, filed on Jul. 30, 2014, which in turn claims the benefit of Japanese Application No. 2013-267111, filed on Dec. 25, 2013, the disclosures of which are incorporated by reference herein.

BACKGROUND OF THE INVENTION

1. Field of the Invention

This disclosure relates to a headphone set including speaker housings each of which incorporates a speaker unit, and a headband enabling a user to wear the speaker housings.

2. Description of the Related Art

Conventionally, as an apparatus which outputs music, various apparatuses are known such as a speaker, an earphone or a headphone set in accordance with a mode where the apparatus is used. The headphone set is used in such a manner where a user wears speaker housings each of which incorporates a speaker unit on user's left and right ears respectively. In case where the headphone includes left and right speaker housings, headband goes around in left and right directions from the crown of the user's head and connects left and right speaker housings. Besides the above-mentioned headphone set, there has been also known a headphone set using a neckband which a user wears in such a manner that left and right speaker housings or the like are connected to each other on a headband going around in left and right directions from a rear side of the user's head.

A headphone set generally used has several adjustment functions such that speaker housings each of which incorporates a speaker unit can be snugly fitted on ears of a user. For example, the headphone set has a function of adjusting an angle of the speaker housing when the speaker housing is brought into contact with the ear or a function of adjusting a length of the headband.

Further, patent literature 1 discloses a technique where when a user wearing glasses uses a headphone set, the user mounts speaker units on temples of glasses which are worn by the user, and the user can change the wearable position of the speaker unit along the frame of the glasses.

CITATION LIST

Patent Literature

PTL 1: Unexamined Japanese Utility-Model Publication No. 59-101586

SUMMARY OF THE INVENTION

However, the shape of the crown of the head of a user of a headphone set or the relative position of the ears of the user with respect to the whole crown of the user's head differs depending on the individual. When the user uses the headphone set in a state where the user is not yet wearing the headphone set in a sufficiently suitable manner, there may arise a drawback that a sound output from a speaker unit cannot sufficiently reach the user's ear. From this point of view, in using the headphone set, the suitable mounting of the speaker housing which incorporates a speaker unit on the user's ear is important for a headphone set.

Accordingly, this disclosure provides a headphone set which can be more snugly mounted on user's ear.

A headphone set according to the this disclosure includes: a speaker housing which incorporates a speaker unit capable of outputting a sound, and is brought into contact with a user; a connecting portion which is connected to the speaker housing in a state where the speaker housing is movable approximately linearly in a forward and rearward direction of the user; and a headband which mounts the connecting portion on an end portion thereof and is wearable on a head of the user in a direction toward a crown of the head of the user.

By using the headphone set of this disclosure, the user can wear the headphone set on user's ear more snugly.

DESCRIPTION OF EXEMPLARY EMBODIMENTS

Hereinafter, exemplary embodiments are described in detail by reference to drawings when appropriate. However, there may be cases where descriptions in detail more than necessary may be omitted. For example, there may be cases where the detailed description of matters which are already well-known and the repeated description of the substantially same constitution are omitted. This avoids the description made hereinafter from being unnecessarily redundant thus facilitating the understanding of the present invention by those who are skilled in the art.

The inventors of the present invention give the accompanying drawings and the following descriptions for allowing those who are skilled in the art to sufficiently understand the present disclosure, and the subject defined in the claims is not intended to be restricted thereby.

First Exemplary Embodiment

Figure 1:
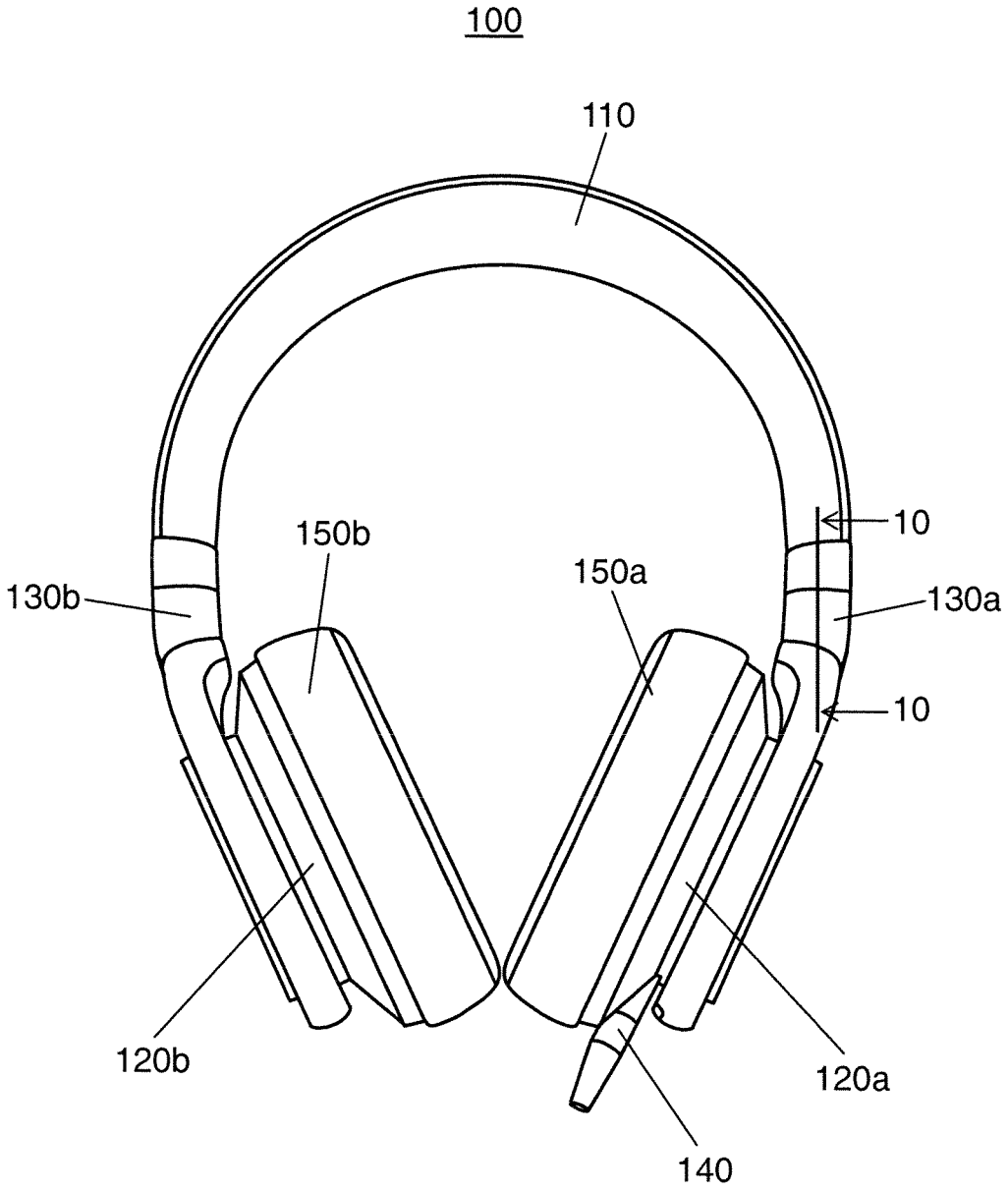
FIG. 1 is a front view of a headphone set described in a first exemplary embodiment.
Figure 2:
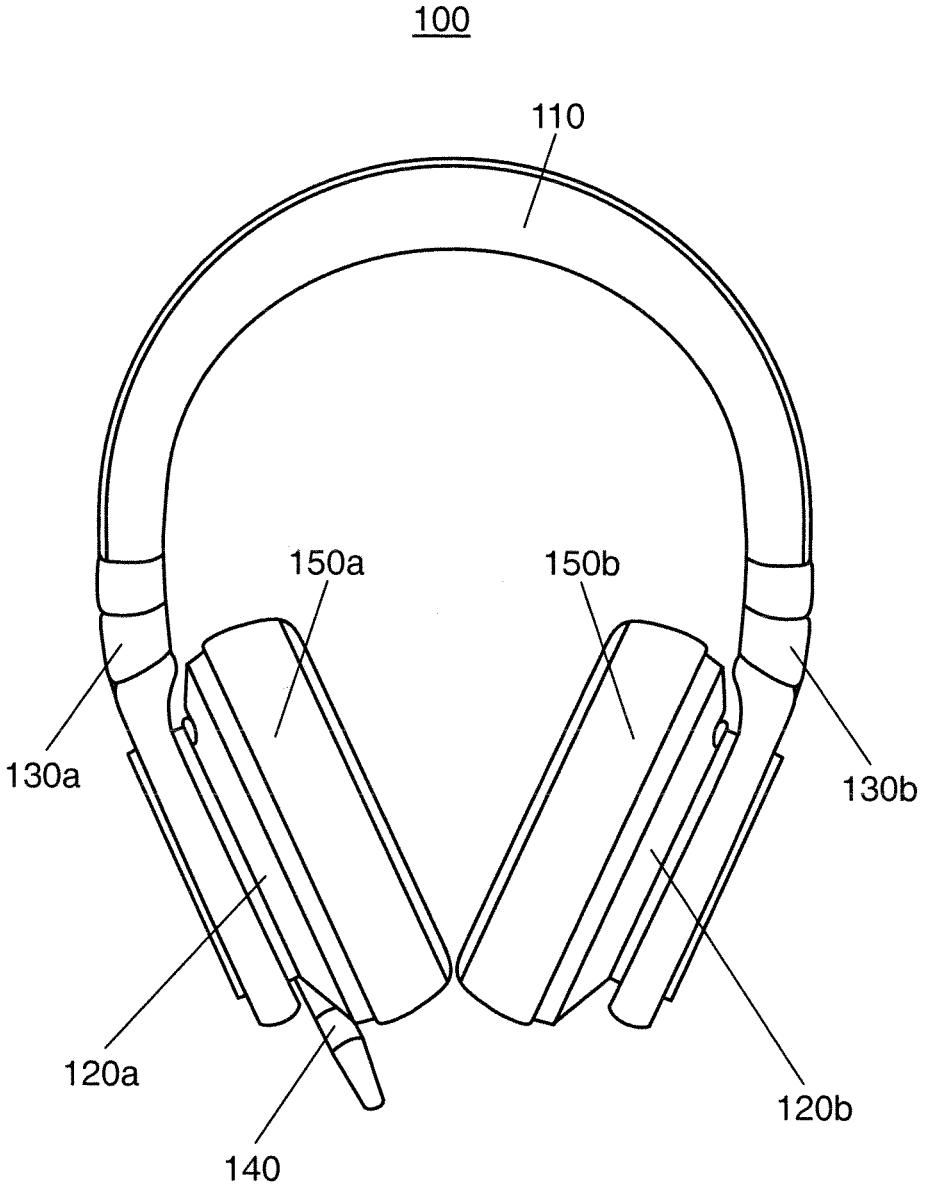
FIG. 2 is a back view of the headphone set described in the first exemplary embodiment.
Figure 3:
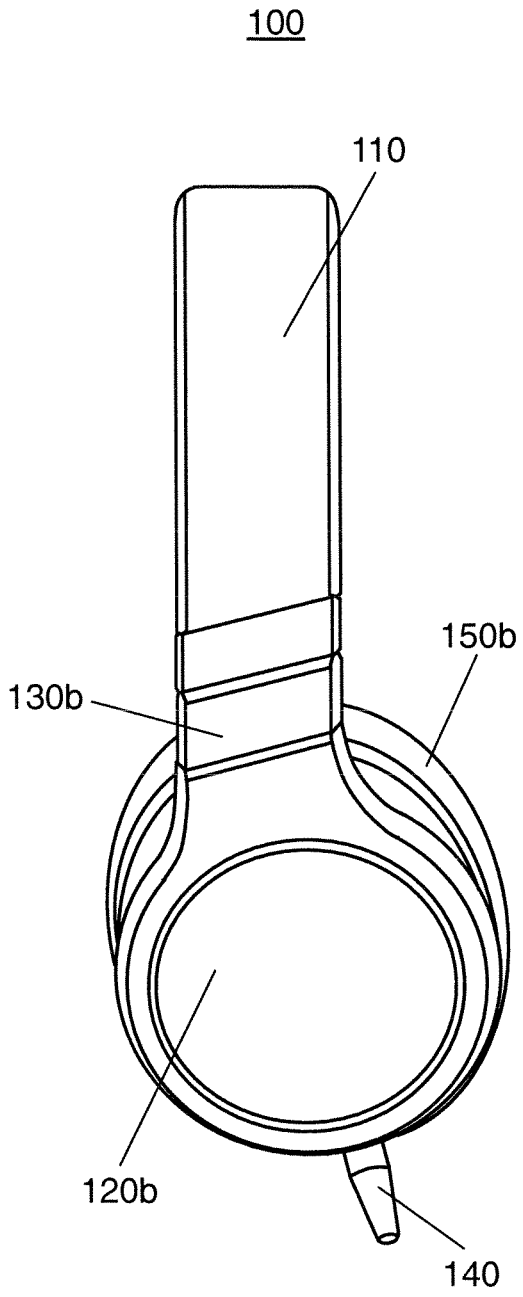
FIG. 3 is a left side view of the headphone set described in the first exemplary embodiment.
Figure 4:
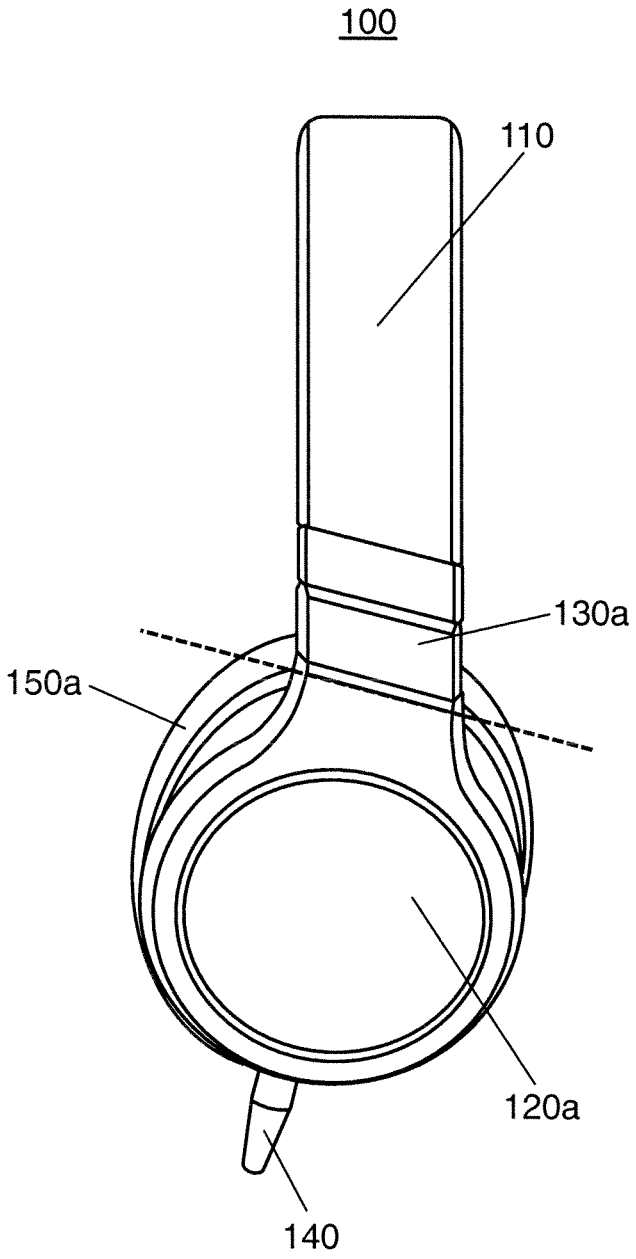
FIG. 4 is a right side view of the headphone set described in the first exemplary embodiment.
Figure 5:
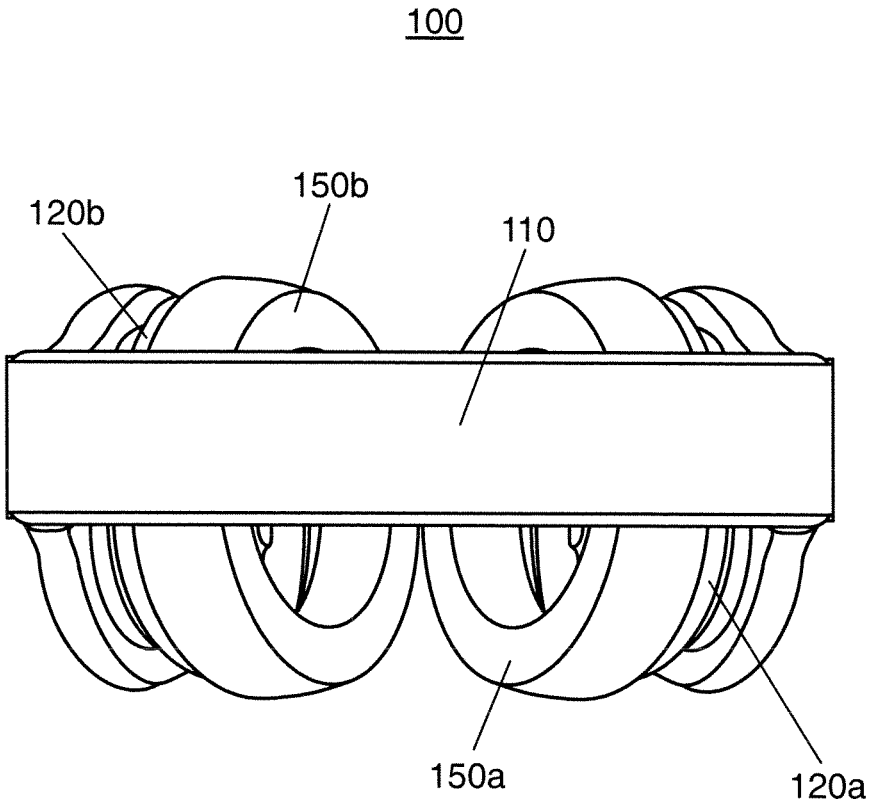
FIG. 5 is a plan view of the headphone set described in the first exemplary embodiment.
Figure 6:
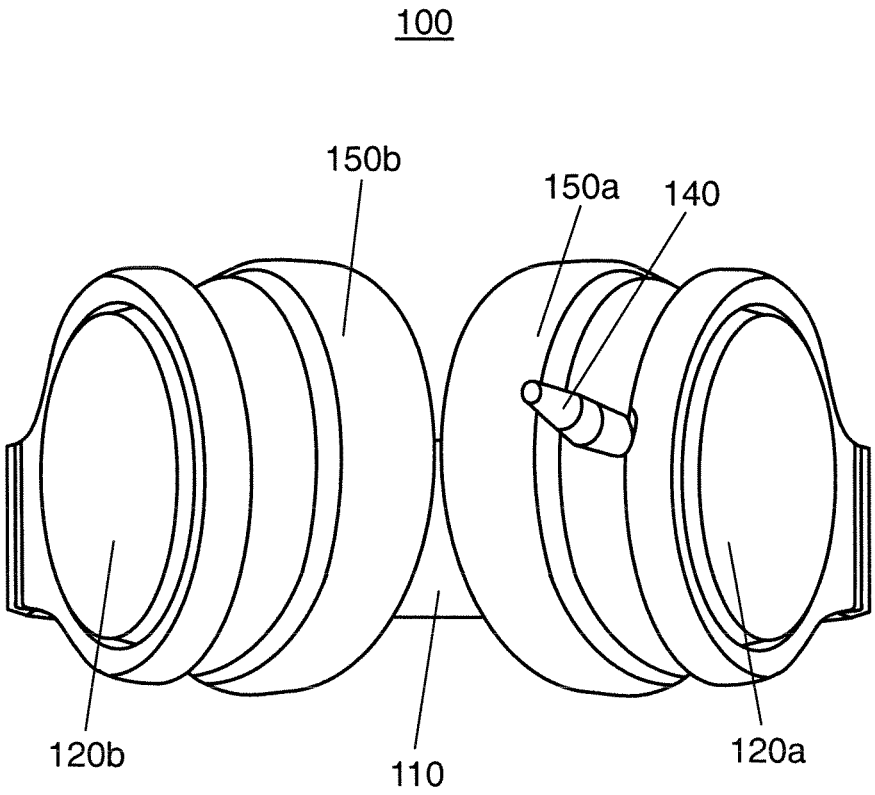
FIG. 6 is a bottom view of the headphone set described in the first exemplary embodiment.
Figure 7:
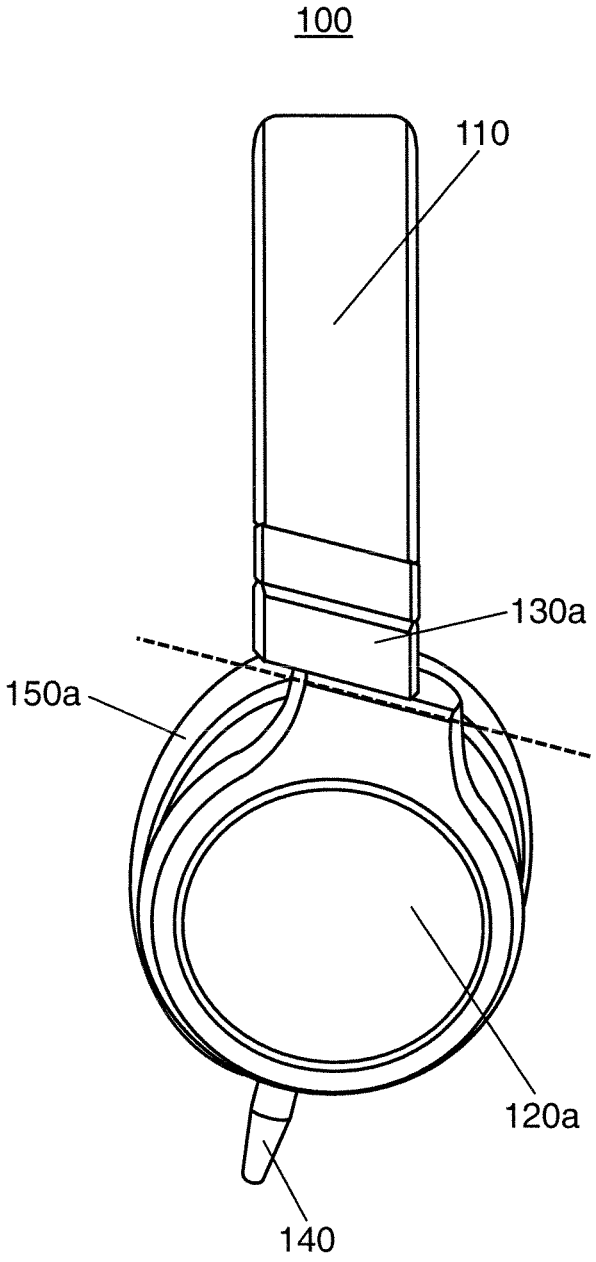
FIG. 7 is another right side view of the headphone set described in the first exemplary embodiment.

FIG. 1 to FIG. 6 are front projection views of headphone set 100 described in this exemplary embodiment. FIG. 1 is a front view of headphone set 100, FIG. 2 is a back view of headphone set 100, FIG. 3 is a left side view of headphone set 100, FIG. 4 is a right side view of headphone set 100, FIG. 5 is a plan view of headphone set 100, and FIG. 6 is a bottom view of headphone set 100. FIG. 7 is another right side view of headphone set 100.

Headphone set 100 includes: headband 110; speaker housings 120*a*, 120*b*; connecting portions 130*a*, 130*b*; and pin jack 140.

Headband 110 supports speaker housings 120*a*, 120*b* arranged on left and right ears of a user wearing headphone set 100. Headband 110 has an approximately arcuate shape such that headband 110 extends along a crown which is an upper part of the head of the user.

Speaker housings 120*a*, 120*b* are connected to both ends of headband 110 respectively. Speaker housing 120*a* is arranged on a left ear of a user wearing headphone set 100, and speaker housing 120*b* is arranged on a right ear of the user wearing headphone set 100. Speaker housings 120*a*, 120*b* respectively incorporate a speaker unit not shown in the drawing which outputs a sound. Ear pad 150*a* is mounted on a portion of speaker housing 120*a* which is brought into contact with the ear of the user, and ear pad 150*b* is mounted on a portion of speaker housing 120*b* which is brought into contact with the ear of the user. Hereinafter, unless otherwise necessary to particularly distinguish left and right speaker housings 120*a*, 120*b* from each other, left and right speaker housings 120*a*, 120*b* are expressed as speaker housings 120. In the same manner, unless otherwise necessary to distinguish ear pads 150*a*, 150*b* from each other, ear pads 150*a*, 150*b* are expressed as ear pads 150.

Connecting portions 130*a*, 130*b* are arranged on different end portions of headband 110 respectively. Connecting portion 130*a* connects headband 110 and speaker housing 120*a* to each other, and connecting portion 130*b* connects headband 110 and speaker housing 120*b* to each other. Hereinafter, unless otherwise necessary to particularly distinguish left and right connecting portions 130*a*, 130*b*, left and right connecting portions 130*a*, 130*b* are expressed as connecting portions 130.

Pin jack 140 has a cord including an input plug not shown in the drawing. The input plug is connected to reproduction equipment, music is reproduced by the reproduction equipment, and the reproduced music is output to headphone set 100.

As shown in FIG. 4 and FIG. 7, a shape of headphone set 100 partially changes. To be more specific, connecting portion 130*a* and speaker housing 120*a* are adjustable in a forward and rearward direction of a user within a predetermined range. To set connecting portion 130*a* as the reference, the position of speaker housing 120*a* is movable within a range from the frontmost position shown in FIG. 4 to the rearmost position shown in FIG. 7. As a result, the shape of headphone set 100 changes as a whole.

The positional relationship of headphone set 100 changes in accordance with a connecting state of connecting portion 130*a* and speaker housing 120*a*. To be more specific, the relative connecting position between connecting portion 130*a* and speaker housing 120*a* changes in the linear direction indicated by a dotted line in FIG. 4 and FIG. 7. Speaker housing 120*a* can change a connecting position thereof in the approximately linear direction along a connecting surface with connecting portion 130*a*. The linear direction shown in FIG. 4 and FIG. 7 is the direction which is formed by connecting a position on a front upper side of a user of the headphone set and a position on a rear lower side of the user of the headphone set.

To set connecting portion 130*a* as the reference, when speaker housing 120*a* moves in a forward direction, that is, in a leftward direction in the drawing, the position of speaker housing 120*a* in the vertical direction is relatively raised, and when speaker housing 120*a* moves in a rearward direction, that is, in a rightward direction in the drawing, the position of speaker housing 120*a* in the vertical direction is relatively lowered. On the other hand, to explain the case where speaker housing 120*a* is set as the reference, when connecting portion 130*a* moves in a forward direction, the position of headband 110 in the vertical direction is relatively raised, and when connecting portion 130*a* moves in a rearward direction, the position of headband 110 in the vertical direction is relatively lowered.

As shown in FIG. 4 and FIG. 7, by changing the positional relationship between connecting portion 130*a* and speaker housing 120*a* in the forward and rearward direction, the positional relationship between headband 110 and speaker housing 120*a* in the forward and rearward direction can be also adjusted.

By adjusting the positional relationship between headband 110 and speaker housing 120*a* in the approximately forward and rearward direction, a user can wear headphone set 100 more snugly.

Although the explanation has been made heretofore with respect to a change in shape of headphone set 100 using a right side view of headphone set 100, in the same manner as described above, the positional relationship between connecting portion 130*b* and speaker housing 120*b* in the forward and rearward direction can be changed also on a left side of headphone set 100.

Figure 8B:
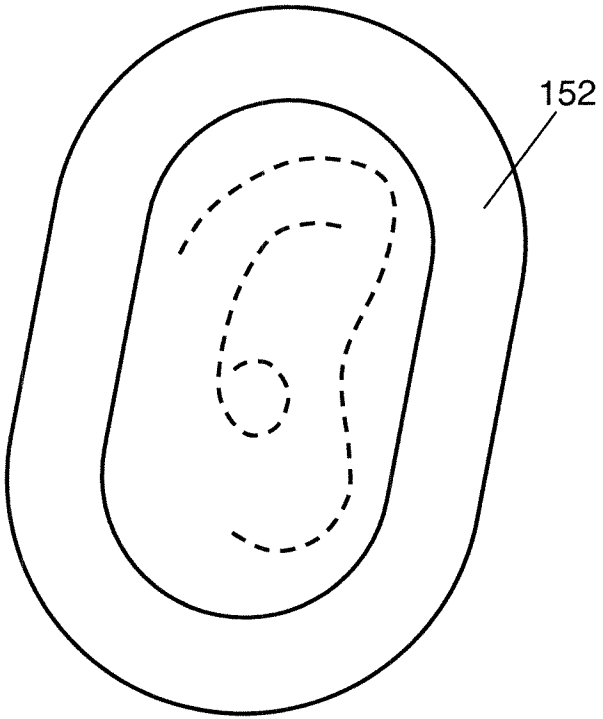
FIG. 8B is another view showing the relationship between the shape of the ear pad described in the first exemplary embodiment and the ear of the user.
Figure 8A:
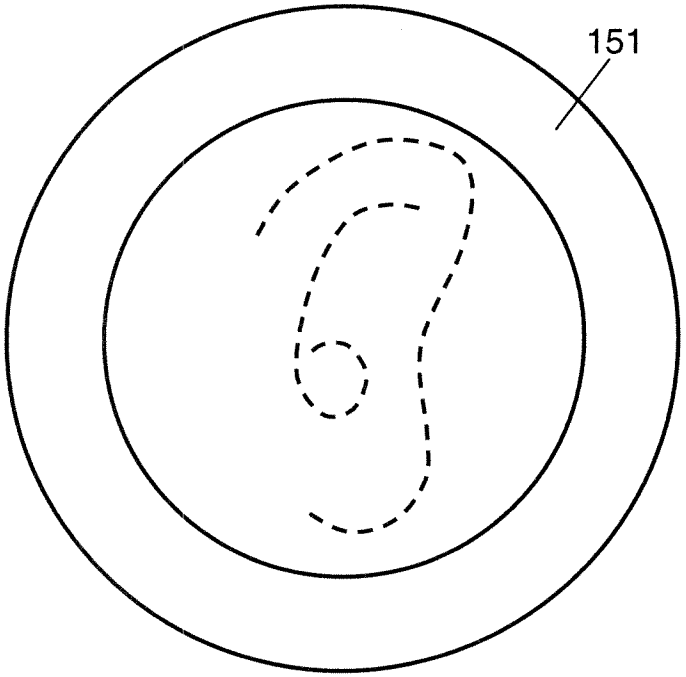
FIG. 8A is a view showing the relationship between a shape of an ear pad described in the first exemplary embodiment and an ear of a user.

FIG. 8A and FIG. 8B are views showing the relationship between a shape of ear pad 150 and an ear of a user. Ear pad 150 is a portion of speaker housing 120 and covers an ear of a user wearing headphone set 100 such that ear pad 150 wraps the ear of the user. Ear pad 150 covers the ear of the user, and the ear of the user is placed in a space surrounded by ear pad 150. Due to such a constitution, a space including the speaker unit and the ear of the user can be formed into a space having a small gap between the speaker unit and the ear of the user, that is, a space as close as possible to a sealed space.

Ear pad 151 shown in FIG. 8A has an approximately perfect circular shape. Due to such a shape, headphone set 100 can acquire an advantageous effect that a user can wear headphone set 100 without taking an angle of ear pad 151 into consideration. That is, when the user uses ear pad 151 at the time of wearing headphone set 100, it is unnecessary for the user to take the direction of ear pad 150 into consideration. On the other hand, it is necessary to set a size of ear pad 150 relatively large for snugly covering an ear even at any angles. However, when ear pad 150 becomes large, headphone set 100 per se also becomes large.

In view of the above, the downsizing of the shape of ear pad 150 is also required as one of factors for making the size of headphone set 100 compact. In this exemplary embodiment, as a more preferred example of ear pad 150, ear pad 150 having a more compact shape is described.

Ear pad 152 shown in FIG. 8B has a compact shape. In general, an ear has a long-axis direction and a short-axis direction. Accordingly, ear pad 152 is also formed into a shape having a long-axis direction and a short-axis direction. In the example shown in FIG. 8B, ear pad 152 has a smaller shape compared to ear pad 151 shown in FIG. 8A and, at the same time, ear pad 152 is formed into an elliptical shape such that the larger number of people can easily use headphone set 100. In this specification, it is not always necessary that the elliptical shape of ear pad 152 has a perfect elliptical shape, and it is sufficient that ear pad 152 has a substantially elliptical shape. It is preferable that ear pad 152 be mounted such that the long-axis direction of an ear of a user and the long-axis direction of the elliptical shape substantially agree with each other.

Due to such a constitution, compared to the case where ear pad 150 has a perfect circular shape, the shape of ear pad 150 can be made further compact. However, in using headphone set 100, it is necessary for the user to wear headphone set 100 by adjusting the direction of ear pad 150 such that ear pad 150 is snugly brought into contact with the ear of the user, that is, such that ear pad 150 wraps the ear.

Even in the case where ear pad 150 has an approximately perfect circular shape as shown in FIG. 8A, when headphone set 100 has a function of adjusting an angle at which speaker housing 120 is brought into contact with an ear of a user, there may be a case where an angle of ear pad 150 at which ear pad 150 is mounted on an ear of a user is substantially restricted due to the restriction imposed on the direction along which the adjustment of the angle can be performed, for example, the restriction imposed on the axial direction along which the adjustment of the angle can be performed. Also in this case, in the same manner as the above-mentioned case, it is necessary for the user to wear headphone set 100 while ear pad 150 is set at a predetermined angle with respect to the ear.

That is, also in the case where ear pad 150 has an approximately perfect circular shape, there may be a case where ear pad 150 cannot be mounted on an ear of a user by rotating ear pad 150 with respect to an axis of rotation perpendicular to a plane in FIG. 8A. Also in this case, it is necessary for the user to wear headphone set 100 while the direction or the like of ear pad 150 is adjusted. In the case where ear pad 150 has the restriction in the wearable direction thereof regardless of the shape, the functions and the like thereof, in using headphone set 100, it is necessary for a user to wear headphone set 100 while these directions are adjusted. In this specification, "wearable direction" means the direction that speaker housing 120 faces with respect to an ear of a user when the user wears headphone set 100 as described above. "has the restriction in the wearable direction" means that headphone set 100 should be used with "wearable direction" restricted to the particular direction.

To make the space which includes the speaker unit and an ear of a user approximate a sealed space as much as possible, it is preferable that ear pad 150 is made of a material capable of suppressing an amount of leakage of a sound output from the speaker unit to the outside of speaker housing 120. To be more specific, it is preferable that ear pad 150 and other parts such as speaker housing 120 are made of materials having low air permeability. As such materials, nylon and synthetic leather can be named as examples.

Generally speaking, a sound output from the speaker unit propagates by vibrating air. When ear pad 150 or the like is made of a raw material having relatively high air permeability, a sound output from the speaker unit passes through the raw material and leaks to the outside of speaker housing 120. At the same time, noises generated outside speaker housing 120 also enter speaker housing 120. These phenomena become factors which deteriorate the quality of a sound to which a user listens using the headphone.

Figure 9:
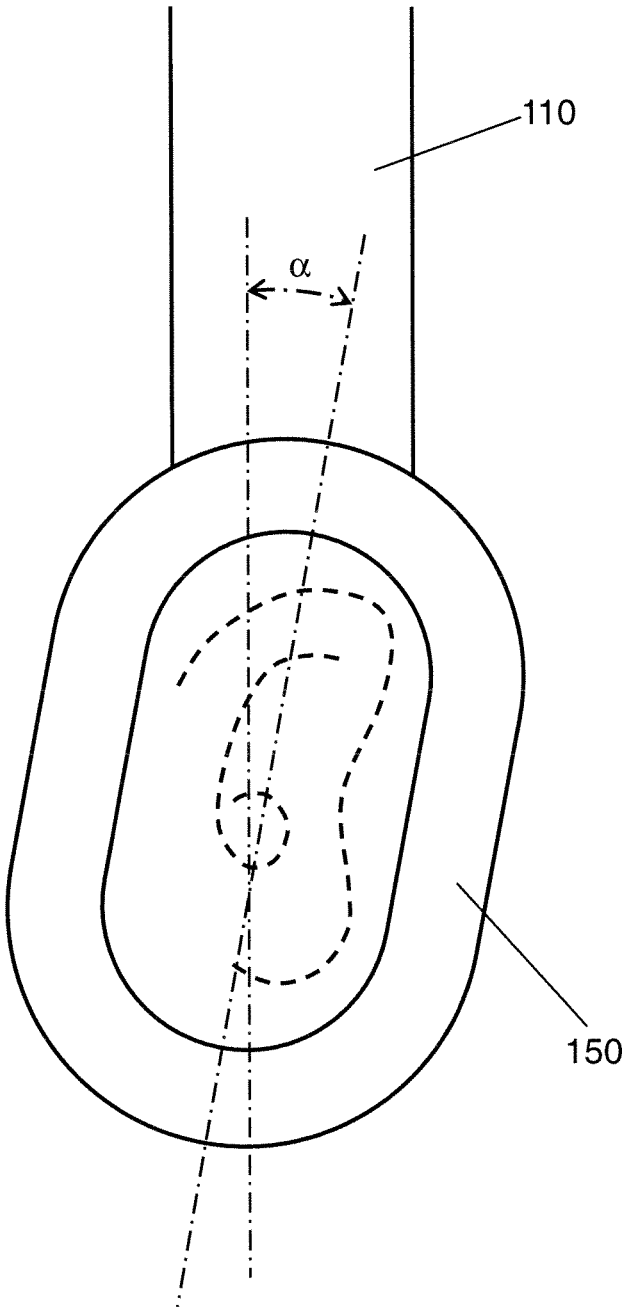
FIG. 9 is a view for describing the positional relationship for connecting a speaker housing and a headband described in the first exemplary embodiment.

FIG. 9 is a view for describing the mounting of speaker housing 120 and headband 110.

As already described previously, it is preferable to form ear pad 150 of speaker housing 120 into an approximately elliptical shape to make headphone set 100 compact. In this case, however, there exists a possibility that the relative positional relationship between ear pad 150 and an ear of a user is restricted. To be more specific, it is necessary to make the long-axis direction of an ear of a user and the long-axis direction of ear pad 150 substantially agree with each other and, at the same time, it is necessary to make the short-axis direction of the ear of the user and the short-axis direction of ear pad 150 substantially agree with each other.

Generally speaking, with respect to a human ear, the long-axis direction of the ear does not agree with the vertical direction, and the ear makes a predetermined angle $\alpha$ with respect to the vertical direction ($0<\alpha<45$: $\alpha$ being the real number). Accordingly, in snugly mounting speaker housing 120 on an ear of a user, to direct headband 110 substantially upwardly in the vertical direction toward the crown of the head of the user, it is necessary to connect headband 110 and speaker housing 120 to each other by taking into account such an angle $\alpha$. That is, headband 110 is connected to speaker housing 120 at an angle $\alpha$ at which the center axis of headband 110 substantially agrees with the vertical direction.

Due to such a constitution, ear pad 150 can be made more compact and, at the same time, in using headphone set 100, an ear of a user can be snugly covered even with ear pad 152 having a compact shape.

Figure 10:
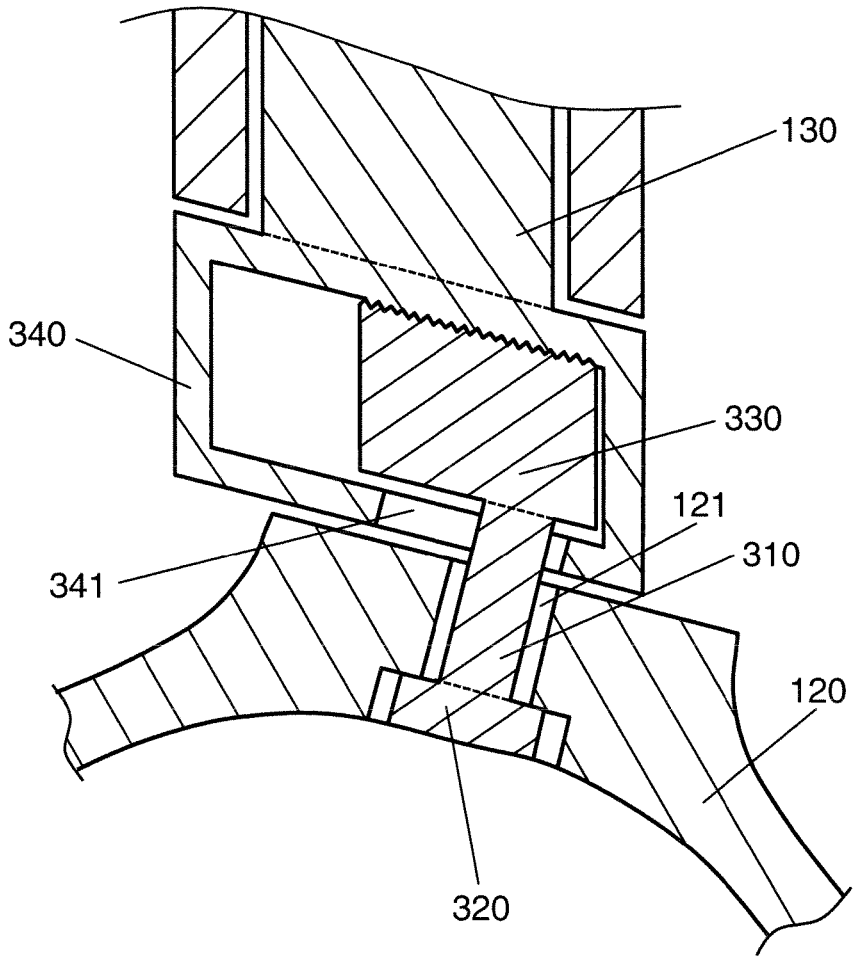
FIG. 10 is a view for describing a constitutional example of a connecting portion described in the first exemplary embodiment.

FIG. 10 is a cross-sectional view taken along a line 10-10 in FIG. 1, and is a view showing one example of the specific constitution of connecting portion 130*a*. FIG. 10 is a cross-sectional view taken along a line 10-10 in FIG. 1 and is a cross-sectional view showing the constitution on a left ear side of a user. However, the constitution of the connecting portion on a right ear side of a user is substantially equal to the constitution of the connecting portion on the left ear side of a user and hence, the description is made by expressing connecting portion 130*a* as connecting portion 130. Connecting portion 130 includes: connecting shaft 310; stopper 320; movable element 330; and connecting portion housing 340.

Connecting shaft 310 physically connects connecting portion 130 and speaker housing 120 to each other. Although not shown in the drawing, the inside of connecting shaft 310 is hollow. The wiring and the like to the speaker unit pass through the hollow portion. Connecting shaft 310 passes through through hole 121 for insertion formed in speaker housing 120.

Stopper 320 is formed on an end portion of connecting shaft 310 on a speaker housing 120 side. Stopper 320 prevents falling of speaker housing 120 from connecting shaft 310. To this end, a longitudinal cross section of stopper 320 is set larger than a longitudinal cross section of through hole 121 formed in speaker housing 120. Stopper 320 is joined to connecting shaft 310 which passes through through hole 121 from an inner side of speaker housing 120.

Movable element 330 is mounted on an end portion of connecting shaft 310 on connecting portion 130 side. Movable element 330 is arranged in the inside of connecting portion housing 340. Movable element 330 prevents falling of connecting shaft 310, stopper 320, and speaker housing 120 from connecting portion 130. Movable element 330 has a shape having a size larger than a size of opening portion 341 formed on connecting portion housing 340.

Movable element 330 is movable in the inside of connecting portion housing 340. Due to such a movement, the position of speaker housing 120 is changeable relative to headband 110. That is, in headphone set 100, the position of speaker housing 120 is adjustable due to the movement of speaker housing 120 in the predetermined forward and rearward direction. A size of a movable range of movable element 330 in the inside of connecting portion housing 340 becomes an amount that the relative position between speaker housing 120 and connecting portion 130 can be adjusted.

Connecting portion housing 340 is a housing which houses movable element 330. As described above, movable element 330 moves the inside of connecting portion housing 340 and hence, connecting portion housing 340 requires a space larger than the shape of movable element 330. Opening portion 341 is formed on a lower portion of connecting portion housing 340 for allowing connecting shaft 310 to pass therethrough.

Speaker housing 120 may be rotatable using connecting shaft 310 as a center axis. When speaker housing 120 rotates, the rotational direction of ear pad 150 of speaker housing 120 can be adjusted in accordance with an angle of a contact surface of an ear of a user.

An inner wall of connecting portion housing 340 and an outer peripheral portion of movable element 330 may be formed into a waveform shape. When movable element 330 moves in the inside of connecting portion housing 340, a resistance of a predetermined force or more is generated at a portion where projections which form the waveform shape are brought into contact with each other. Accordingly, when speaker housing 120 is moved forward or rearward, a user can perceive a feeling of resistance of a predetermined force or more. The resistance of a predetermined force or more is generated at the portion where the waveform-shaped projections are brought into contact with each other every time movable element 330 moves in the inside of connecting portion housing 340.

In the same manner, grease having predetermined or more viscosity, for example, may be injected into a space formed in the inside of connecting portion housing 340. When movable element 330 moves in the inside of connecting portion housing 340, the grease becomes a resistance to the movement. Accordingly, when speaker housing 120 is moved forward or rearward, a user can perceive a feeling of resistance of a predetermined force or more.

The reason that the above-mentioned feeling of resistance is imparted to a user is that even when a user wearing headphone set 100 moves to some extent, it is possible to prevent the occurrence of a state where headband 110 or speaker housing 120 adjusted by a user easily collapses. When the positional relationship of headband 110 or speaker housing 120 to which adjustment is already applied collapses, a quality of a sound to which a user of headphone set 100 listens is deteriorated. To maintain the wearability of headphone set 100 even when a user moves, it is necessary that the contents of the adjustments applied to the various adjustment portions are surely maintained. In view of the above, as described above, to maintain the position of speaker housing 120, the constitution which generates a predetermined feeling of resistance may be adopted.

To the contrary, for example, the constitution may be adopted where a rotational angle of speaker housing 120 is changed following the movement of a user at a portion of speaker housing 120 where speaker housing 120 is rotated about connecting shaft 310. In such a portion, the above-mentioned constitution becomes unnecessary for making a feeling of resistance relatively small.

As described above, the constitution may be adopted where the respective parts of headphone set 100 differ in feeling of resistance from each other in accordance with contents of adjustments applied to the respective parts. As described above, it is preferable to impart a relatively large feeling of resistance to the portion of connecting portion 130 which is described in conjunction with this exemplary embodiment.

Figure 11B:
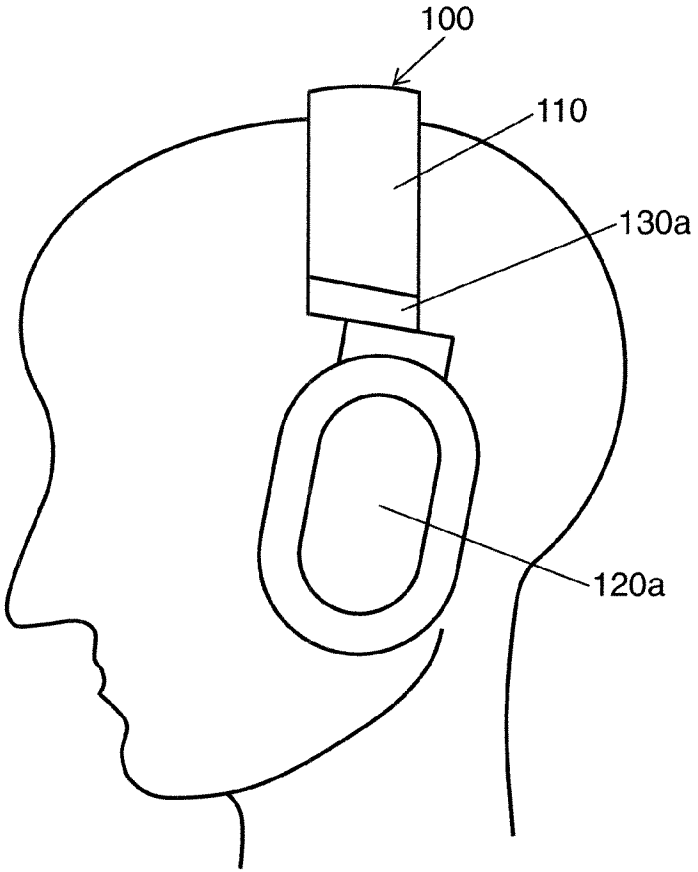
FIG. 11B is a view showing another example where a user wears the headphone set described in the first exemplary embodiment.
Figure 11A:
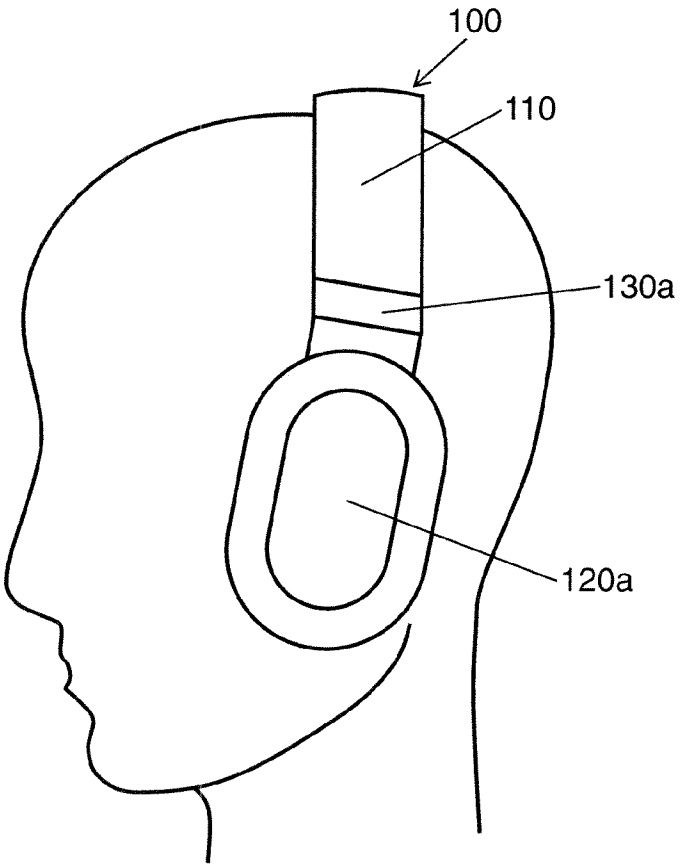
FIG. 11A is a view showing one example where a user wears the headphone set described in the first exemplary embodiment.

FIG. 11A is a view showing one example where a user wears headphone set 100 of this exemplary embodiment. FIG. 11B is a view showing another example where the user wears headphone set 100 of this exemplary embodiment.

FIG. 11A shows the example where connecting portion 130*a* is set as the reference and the position of speaker housing 120*a* is adjusted to the frontmost position. A user can snugly wear headphone set 100 under a favorable condition without changing the position of connecting portion 130*a* and the position of speaker housing 120*a*. The user can enjoy a sound output from headphone set 100 with high quality by wearing headphone set 100.

FIG. 11B shows one example where connecting portion 130*a* is set as the reference and the position of speaker housing 120*a* is adjusted to the rearmost position.

The position of connecting portion 130*a* and the position of speaker housing 120*a* are adjusted. To describe the steps of adjustment in detail, firstly, speaker housing 120 is snugly mounted on an ear of a user. Then, while maintaining the position of speaker housing 120*a* and while moving headband 110 with respect to speaker housing 120*a*, the location where headband 110 can be mounted on the user in a most stable manner is sought, and headband 110 is mounted on the user at such a location. Due to such adjustment, the user can wear headphone set 100 under a favorable condition. As a result, a user can enjoy a sound output from headphone set 100 with high quality.

Particularly, when headphone set 100 is of a type where ear pad 150 is formed of ear pad 152 having an elliptical shape and an amount of sound leaked to the outside of speaker housing 120 is suppressed to a predetermined amount or less with respect to a sound output from the speaker unit, the position of ear pad 152 is decided substantially based on the location and the direction of an ear of a user. In adjusting the position of headband 110 with reference to the position of ear pad 152, by adjusting the position of headband 110 in the forward or rearward direction with respect to speaker housing 120, the user can wear headphone set 100 in a more favorable state.

Headphone set 100 which can suppress an amount of sound leaked to the outside of speaker housing 120 with respect to a sound output from the speaker unit at the time of using headphone set 100, may be generally referred to as "sealed headphone set". However, "sealed" does not mean a completely "closed state", and it is understood that "sealed" includes a state where an amount of leaked sound is equal to or less than a predetermined amount. Also in this disclosure, the expression "sealed headphone set" is used in this context.

In the above-mentioned description, the advantageous effects of headphone set 100 brought about by this exemplary embodiment has been described by taking the relationship between the position of an ear of a user and the position of a crown of a head of the user, as an example. However, the wearability of headphone set 100 is not limited to the above-mentioned example, and may depend on other factors.

As has been described above, in headphone set 100 which is described in conjunction with this exemplary embodiment, the positional relationship between connecting portion 130 and speaker housing 120 is movable in a forward and rearward direction of the user. Due to such mobility, the wearability of headphone set 100 can be enhanced.

In the examples shown in FIG. 11A and FIG. 11B, the case where a moving amount of headband and the speaker housing is 0 and the case where the moving amount of headband and the speaker housing is maximum are exemplified. However, the content of this exemplary embodiment is not limited to such cases. That is, provided that the moving amount of headband and the speaker housing falls within a range from a minimum value (0) to a maximum value, a user can wear headphone set 100 with any moving amount. That is, headphone set 100 of this exemplary embodiment is characterized in that connecting portion 130 and speaker housing 120 are connected to each other in a state where connecting portion 130 and speaker housing 120 can be continuously offset in a forward and rearward direction of the user.

The positional relationship between headband 110 and speaker housing 120 may be adjusted in such a manner that a user himself manually operates headband 110 and speaker housing 120, or may be adjusted in such a manner that an actuator such as a motor or the like is additionally mounted on connecting portion 130 and the positional relationship is adjusted using power of the actuator. When the positional relationship is adjusted by operating the actuator, headphone set 100 may be configured such that a memory and a controller are mounted on headphone set 100, the positional relationship between headband and speaker housing 120 is stored in the memory for every user, and the favorable positional relationship can be reproduced for every user.

In this exemplary embodiment, as exemplified in FIG. 4 and FIG. 7, the description is made in conjunction with drawing with respect to the case where when speaker housing 120 is assumed as a movable portion while headband 110 is set as the reference, an offset amount which is a moving amount between headband 110 and speaker housing 120 becomes 0 when speaker housing 120 is at the frontmost position, and the offset amount becomes maximum when speaker housing 120 is at the rearmost position. However, the headphone set of this disclosure is not limited to the above-mentioned example. The headphone set of this disclosure may be configured such that an offset amount between headband 110 and speaker housing 120 becomes maximum when speaker housing 120 is at the frontmost position and the offset amount becomes 0 when speaker housing 120 is at the rearmost position. Further, the headphone set of this disclosure may be configured such that an offset amount between headband 110 and speaker housing 120 is generated both at the frontmost position and at the rearmost position.

However, as described in conjunction with this exemplary embodiment, by adopting the positional relationship where an offset amount between headband 110 and speaker housing 120 becomes 0 either at the frontmost position or at the rearmost position, an advantageous effect is acquired that which position becomes the reference can be easily set in designing the headphone set.

The positional relationship between connecting portion 130 and speaker housing 120 may be visually recognized by a user.

Figure 12:
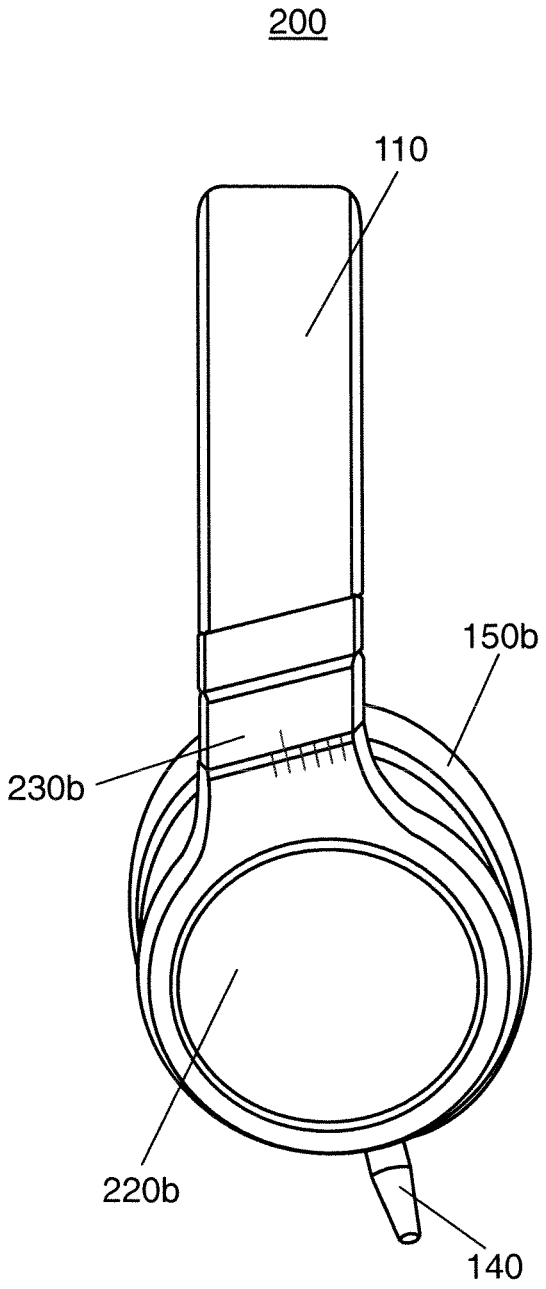
FIG. 12 is a left side view of another headphone set described in the first exemplary embodiment.
Figure 13:
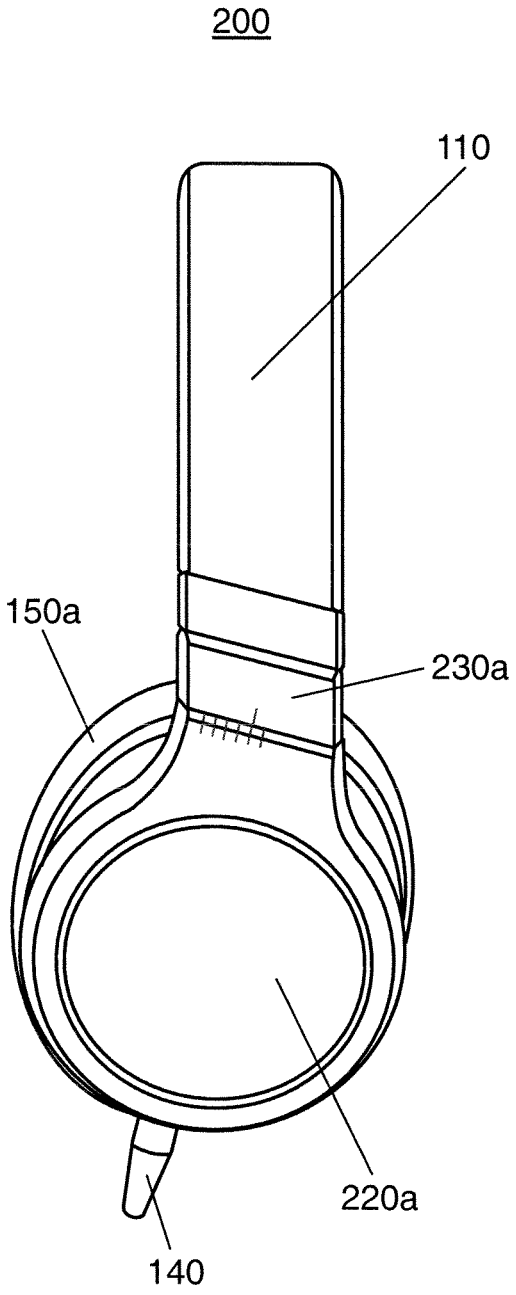
FIG. 13 is a right side view of another headphone set described in the first exemplary embodiment.
Figure 14:
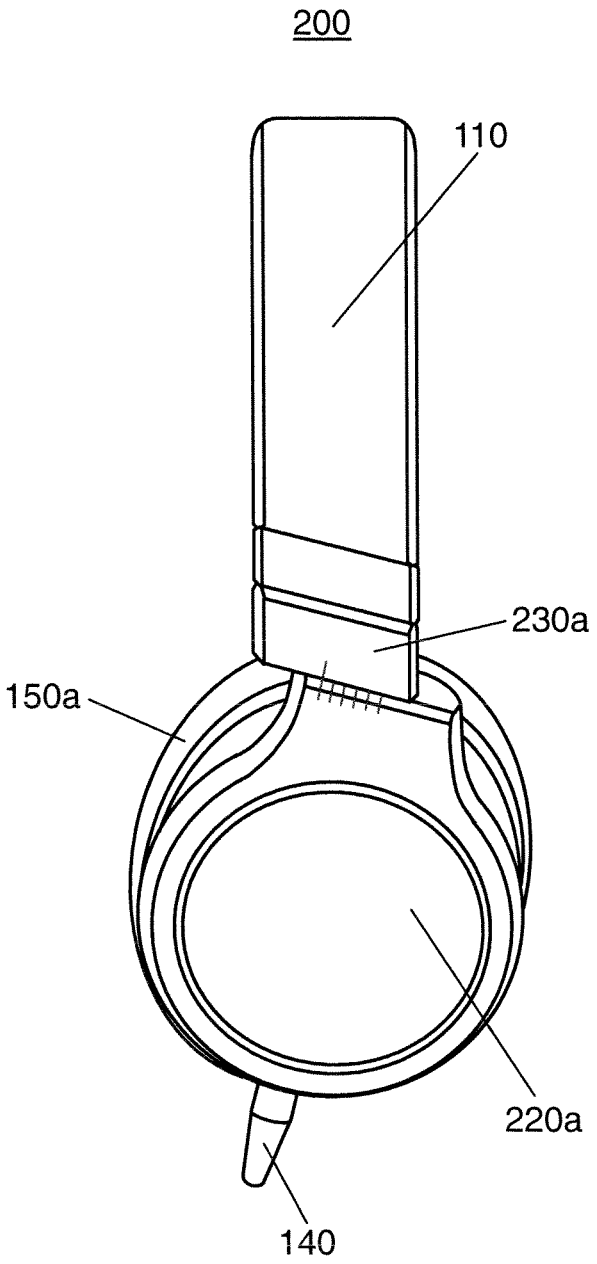
FIG. 14 is a right side view when a shape of another headphone set described in the first exemplary embodiment changes.

FIG. 12 is a left side view of headphone set 200 of such an exemplary embodiment, FIG. 13 is a right side view of headphone set 200 of this exemplary embodiment, and FIG. 14 is another right side view of headphone set 200 of this exemplary embodiment.

Headphone set 200 includes: headband 110; speaker housings 220*a*, 220*b*; connecting portions 230*a*, 230*b*; and pin jack 140. A point which makes headphone set 200 different from headphone set 100 lies in that a scale is provided to speaker housings 220*a*, 220*b* and connecting portions 230*a*, 230*b* for allowing a user to visually recognize an adjustment amount. Due to the provision of the scale, the user can confirm whether or not the substantially same adjustment is made with respect to user's left and right ears based on the position of the scale.

Second Exemplary Embodiment

In this exemplary embodiment, the description is made mainly with respect to the point which makes this exemplary embodiment differ from the first exemplary embodiment.

Figure 15A:
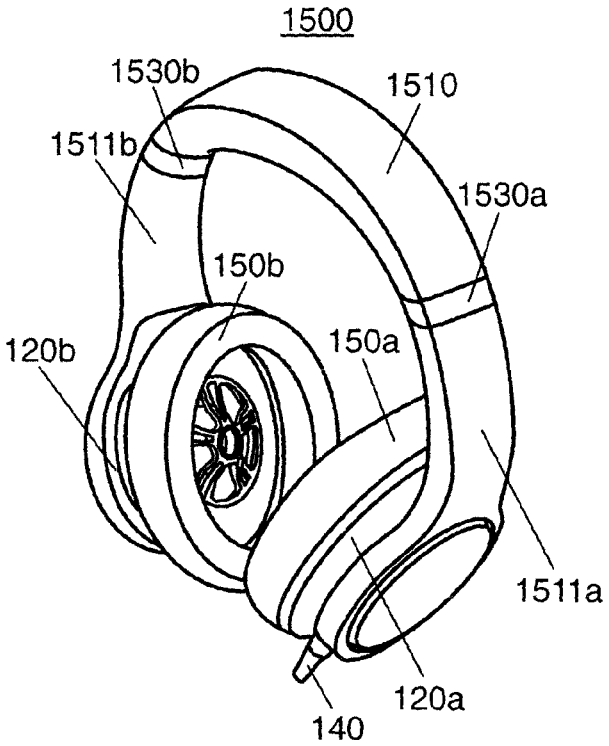
FIG. 15A is a perspective view of a headphone set described in a second exemplary embodiment.
Figure 15B:
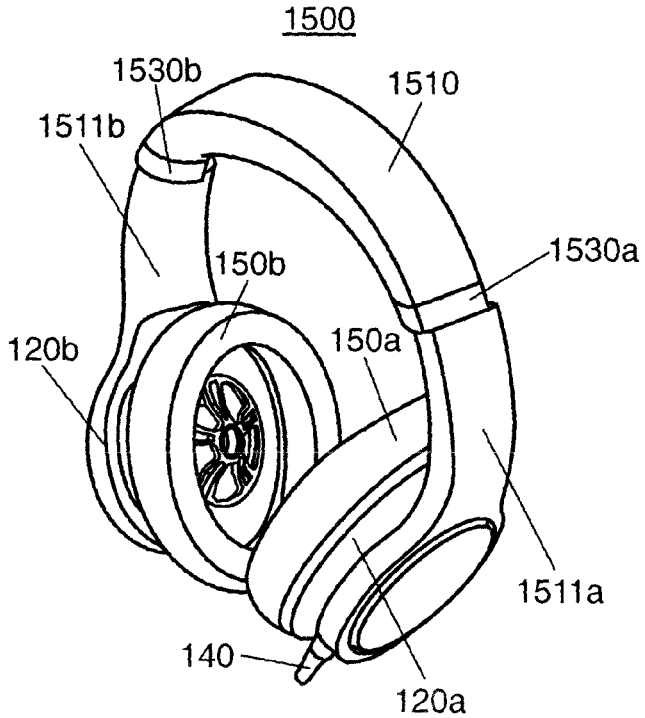
FIG. 15B is another perspective view of the headphone set described in the second exemplary embodiment.

FIG. 15A is a perspective view of headphone set 1500 of this exemplary embodiment, and FIG. 15B is another perspective view of headphone set 1500 of this exemplary embodiment.

Headphone set 1500 includes: headband upper portion 1510; headband lower portions 1511*a*, 1511*b*; connecting portions 1530*a*, 1530*b*; speaker housings 120*a*, 120*b*; and pin jack 140.

Headband upper portion 1510 has an approximately arcuate shape along a crown of a head of a user.

Headband lower portions 1511*a*, 1511*b* support speaker housings 120*a*, 120*b* arranged on left and right ears of the user wearing headphone set 1500 respectively.

Ear pad 150*a* is mounted on a portion of speaker housing 120*a* which is brought into contact with the ear of the user, and ear pad 150*b* is mounted on a portion of speaker housing 120*b* which is brought into contact with the ear of the user.

Connecting portion 1530*a* connects headband upper portion 1510 and headband lower portion 1511*a* to each other, and connecting portion 1530*b* connects headband upper portion 1510 and headband lower portion 1511*b* to each other.

Headphone set 1500 described in this exemplary embodiment is characterized in that headband upper portion 1510 and headband lower portions are relatively movable by way of connecting portions 1530*a*, 1530*b*.

In the first exemplary embodiment, headphone set 100 is configured such that connecting portion 130 between headband 110 and speaker housing 120 realizes the moving function of speaker housing 120 simultaneously with the connecting function. In this exemplary embodiment, the moving function of connecting portions 1530*a*, 1530*b*, the connecting function between headband lower portion 1511*a* and speaker housing 120*a*, and the connecting function between headband lower portion 1511*b* and speaker housing 120*b* have the different constitutions. Such a constitution can acquire an advantageous effect that individual constitutional parts can be realized with relatively simple mechanism compared to the constitution where a plurality of functions are imparted to one constitution.

This exemplary embodiment also has an advantageous effect that when a user wears headphone set 1500 of this exemplary embodiment, operations for adjusting wearability are realized by controlling different mechanisms respectively and hence, the adjustment can be performed relatively easily.

Third Exemplary Embodiment

Also in this exemplary embodiment, in the same manner as the second exemplary embodiment, the description is made mainly with respect to the point which makes this exemplary embodiment differ from the first exemplary embodiment.

Figure 16:
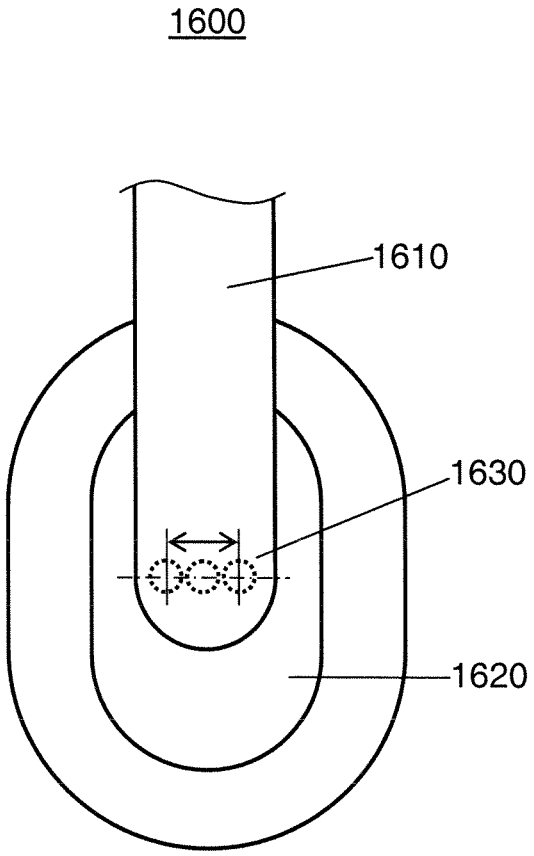
FIG. 16 is a view for describing a connecting portion between a headband and a speaker housing of the headphone set described in a third exemplary embodiment.

FIG. 16 is a view for describing a connecting portion between headband 1610 and speaker housing 1620 of headphone set 1600 described in this exemplary embodiment.

Headphone set 1600 includes: headband 1610; connecting portions 1630; speaker housings 1620; and pin jack 140.

Headband 1610 supports speaker housings 1620 arranged on left and right ears of a user wearing headphone set 1600. Headband 1610 has an approximately arcuate shape along a crown of a head of the user.

Speaker housings 1620 are connected to both ends of headband 1610. Speaker housings 1620 are arranged on left and right ears of the user wearing headphone set 1600. Speaker housing 1620 incorporates a speaker unit not shown in the drawing which outputs a sound. Ear pad 150 is mounted on a portion of speaker housing 1620 which is brought into contact with the ear of the user.

Connecting portion 1630 is arranged on an end portion of headband 1610. Connecting portion 1630 connects headband 1610 and speaker housing 1620 to each other.

Headphone set 1600 of this exemplary embodiment is characterized in that headband 1610 has lower ends which extend to a position where each lower end covers speaker housing 1620, and connecting portion 1630 and speaker housing 1620 are connected to each other at a position where the lower end covers speaker housing 1620. That is, in headphone set 1600 of this exemplary embodiment, headband 1610 and speaker housings 1620 are connected to each other in a positional relationship where headband 1610 and each speaker housing 1620 overlap with each other as viewed in a side view.

In the case of this exemplary embodiment, headband 1610 and connecting portions 1630 may have the different constitutions, or connecting portions 1630 may be integrally formed with headband 1610.

In the same manner as the first exemplary embodiment, connecting portion 1630 also has a function of forward or rearward moving speaker housing 1620 with respect to headband 1610. A user of headphone set 1600 can perform the adjustment of speaker housing 1620 at this portion in a concentrated manner.

Fourth Exemplary Embodiment

In this exemplary embodiment, the description is made with respect to a headphone set which has the constitution differing from the constitutions of the first to third exemplary embodiments, and can be snugly mounted on an ear of a user.

Figure 17:
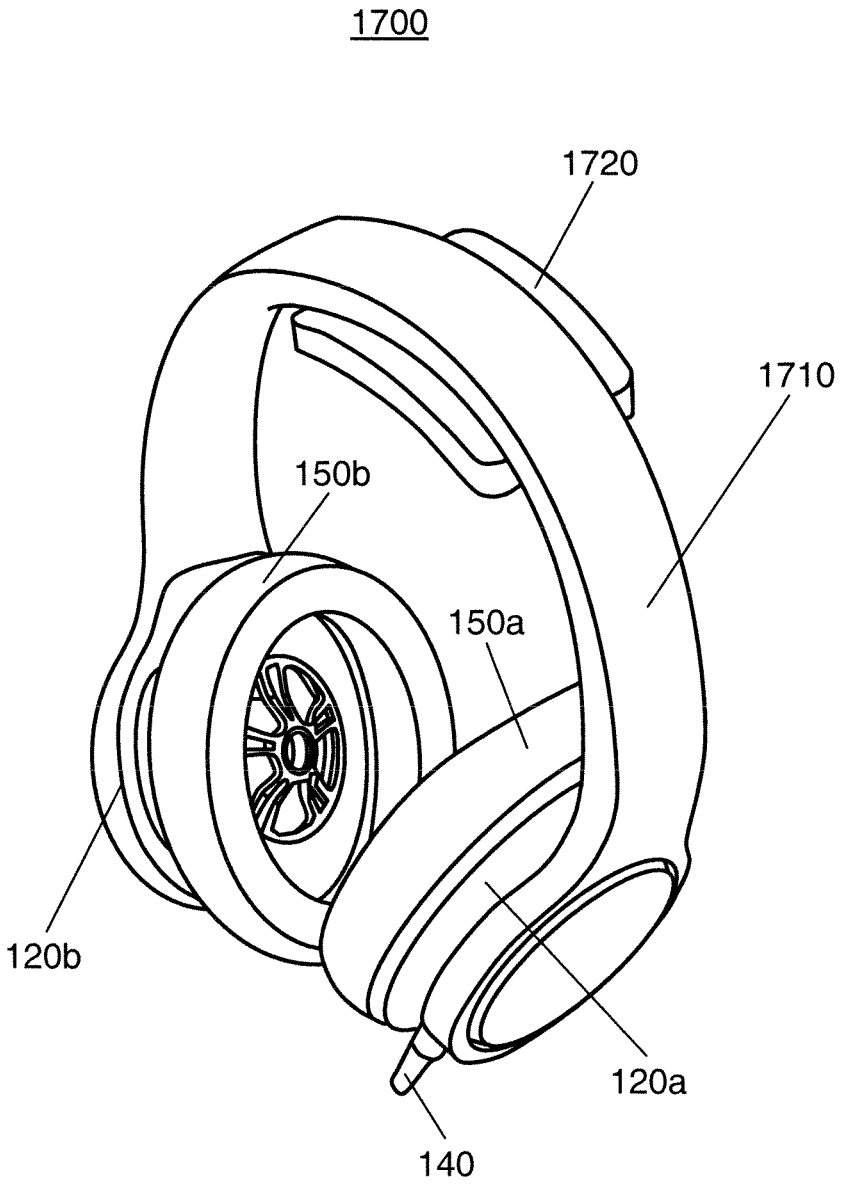
FIG. 17 is a perspective view of a headphone set described in a fourth exemplary embodiment.
Figure 18:
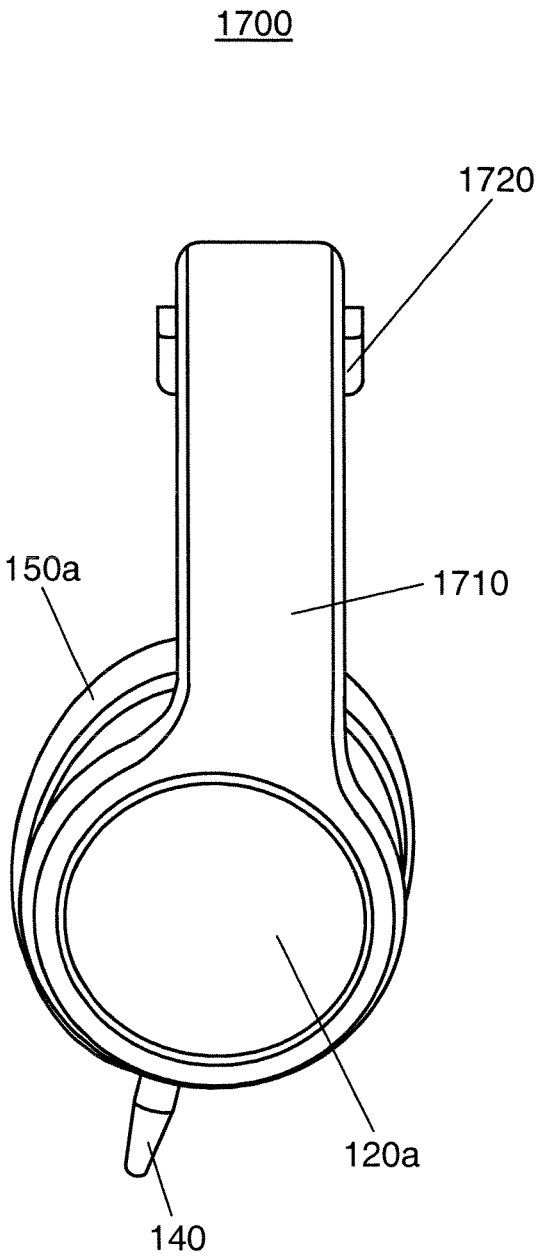
FIG. 18 is a right side view of the headphone set described in the fourth exemplary embodiment.
Figure 19:
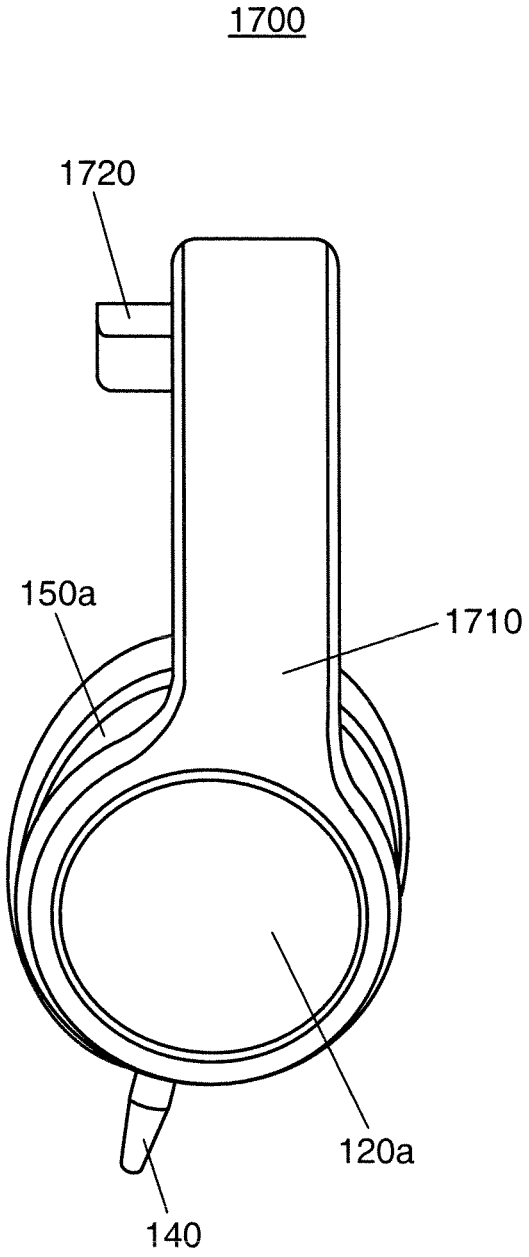
FIG. 19 is another right side view of the headphone set described in the fourth exemplary embodiment.
Figure 20:
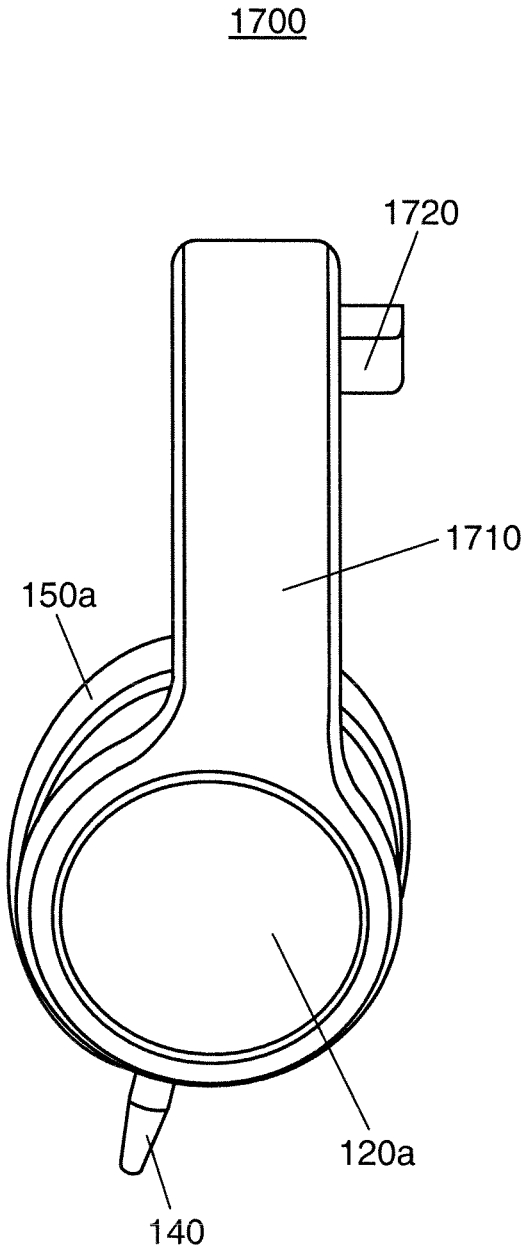
FIG. 20 is still another right side view of the headphone set described in the fourth exemplary embodiment.
Figure 21A:
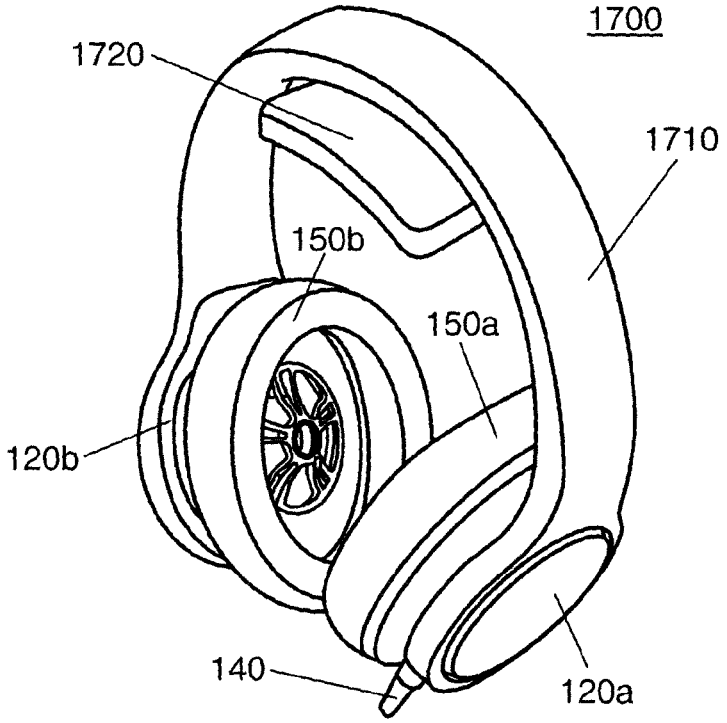
FIG. 21A is another perspective view of the headphone set described in the fourth exemplary embodiment.
Figure 21B:
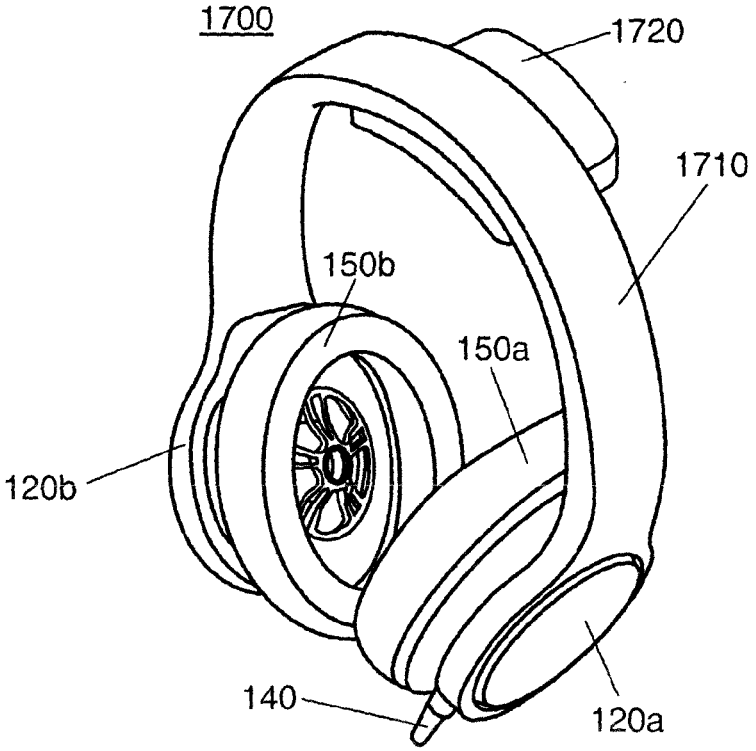
FIG. 21B is still another perspective view of the headphone set described in the fourth exemplary embodiment.

FIG. 17 is a perspective view of headphone set 1700 of this exemplary embodiment, FIG. 18 is a right side view of headphone set 1700 of this exemplary embodiment, FIG. 19 is another right side view of headphone set 1700 of this exemplary embodiment, FIG. 20 is a still another right side view of headphone set 1700 of this exemplary embodiment, FIG. 21A is another perspective view of headphone set 1700 of this exemplary embodiment, and FIG. 21B is still another perspective view of headphone set 1700 of this exemplary embodiment.

Headphone set 1700 includes headband 1710; head pad 1720; speaker housings 120*a*, 120*b*; and pin jack 140.

Headband 1710 supports speaker housings 120*a*, 120*b* which are arranged on left and right ears of a user wearing headphone set 1700. Headband 1710 has an approximately arcuate shape along a crown of a head of the user.

Speaker housings 120*a*, 120*b* are connected to both ends of headband 1710 respectively. Speaker housings 120*a*, 120*b* are arranged on left and right ears of the user wearing headphone set 1700. Speaker housings 120*a*, 120*b* respectively incorporate a speaker unit not shown in the drawing which outputs a sound. Further, ear pads 150*a*, 150*b* are mounted on portions of speaker housings 120*a*, 120*b* which are brought into contact with the ears of the user respectively.

Head pad 1720 is mounted on a portion of headband 1710 which is brought into contact with a portion in the vanity of the crown of the head of the user. Head pad 1720 is actually brought into contact with the head of the user. Head pad 1720 has a width larger than a width of headband 1710 in the forward and rearward direction.

Head pad 1720 can change the position thereof in the forward and rearward direction with respect to headband 1710. FIG. 19 shows a state where head pad 1720 is moved toward a front side. On the other hand, FIG. 20 shows a state where head pad 1720 is moved toward a rear side. In the same manner, FIG. 21A shows a state where head pad 1720 is moved toward a front side, and FIG. 21B shows a state where head pad 1720 is moved toward a rear side.

Figure 22A:
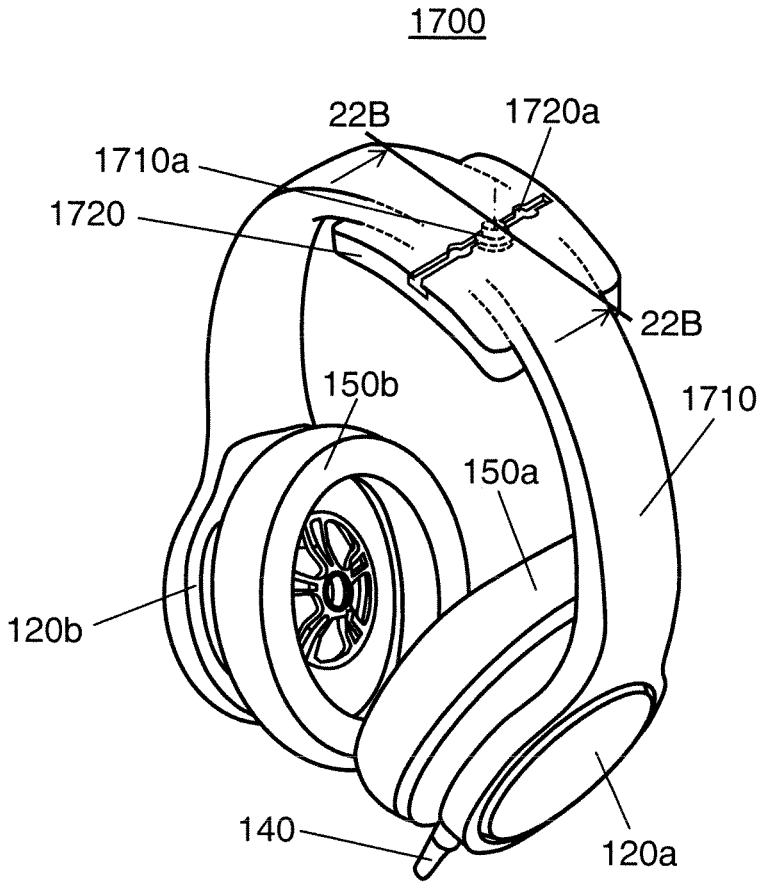
FIG. 22A is a view showing one example of the internal structure of a headband and a head pad of the headphone set described in the fourth exemplary embodiment.
Figure 22B:
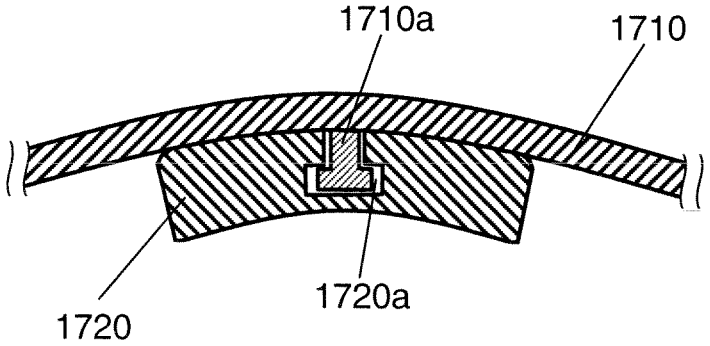
FIG. 22B is a cross-sectional view taken along a line 22B-22B in FIG. 22A.

FIG. 22A is a view showing one example of the internal structure of headband 1710 and head pad 1720 of headphone set 1700, and FIG. 22B is a cross-sectional view taken along a line 22B-22B in FIG. 22A.

Headband 1710 has inverted T-shaped projection 1710*a*, and head pad 1720 has inverted T-shaped groove 1720*a*. By fitting inverted T-shaped projection 1710*a* in inverted T-shaped groove 1720*a* and by sliding inverted T-shaped projection 1710*a*, head pad 1720 can change the position thereof in the forward and rearward direction with respect to headband 1710.

By adjusting the position of head pad 1720 in the forward and rearward direction with respect to headband 1710, a contact point between headphone set 1700 and the head of the user when headphone set 1700 is mounted on the user can be changed in the forward and rearward direction. That is, in headphone set 1700 of this exemplary embodiment, speaker housings 120*a*, 120*b* are mounted on the ears of the user in a favorable state, and the position of headband 1710 with respect to the head of the user is decided based on such mounting of speaker housings 120*a*, 120*b*. However, in such a method, there is a possibility that the user cannot wear headphone set 1700 in a stable manner depending on a user. Accordingly, head pad 1720 is provided between headband 1710 and the head of the user so that the position of head pad 1720 is made movable in the forward and rearward direction.

Due to such a constitution, unlike the first to third exemplary embodiments, headband 1710 of this exemplary embodiment has a function of supporting speaker housings 120*a*, 120*b* as a main function thereof, and a function of wearing headphone set 1700 on the user is allocated to head pad 1720. Head pad 1720 is movable in the forward and rearward direction with respect to headband 1710 and hence, the position of head pad 1720 at the time of wearing headphone set 1700 can be adjusted in the forward and rearward direction. Due to such a constitution, both the suitable wearing of ear pads 150*a*, 150*b* and the stable wearing of headphone set 1700 can be realized.

That is, headphone set 1700 described in this exemplary embodiment includes: speaker housings 120*a*, 120*b* each having the speaker unit; headband 1710 which supports speaker housings 120*a*, 120*b*; and head pad 1720 which is brought into contact with a head of a user wearing headphone set 1700 and is mounted on headband 1710 in a forward and rearward movable manner.

Due to such a constitution, headphone set 1700 described in this exemplary embodiment can be snugly mounted on ears of a user.

In the above-mentioned description, for the sake of brevity, the description has been made on the premise that there is no positional adjustment of headband 1710 and speaker housings 120*a*, 120*b* in the forward and rearward direction which is described in the first to third exemplary embodiments. However, this disclosure is not limited to the above-mentioned exemplary embodiment. The contents described in the first to third exemplary embodiments and the content of this exemplary embodiment may be combined together.

Other Modifications

In the first to fourth exemplary embodiments, the description has been made with respect to the headphone set where the speaker housings are arranged on left and right ears of a user. However, the content disclosed in this disclosure is not limited to the above-mentioned exemplary embodiments. For example, this disclosure is applicable to a headphone set where a speaker housing having a speaker unit is provided to one of left and right sides.

The disclosure is available in a headphone set as an acoustic device.

What is claimed is:

1. A headphone set comprising:

a speaker housing which incorporates a speaker unit capable of outputting a sound, and is brought into contact with a user;

a connecting portion connected to the speaker housing in a state where the speaker housing is movable approximately linearly in a forward and rearward direction of the user;

a headband which mounts the connecting portion on an end portion and is wearable on a head of the user in a direction toward a crown of the head of the user; and an ear pad, wherein:

the ear pad has an approximately elliptical shape, the speaker housing and the headband are connected to each other with a predetermined angle $\alpha$ formed between a direction of a center axis of the headband and a long axis direction of the ear pad in a state where the center axis of headband extends in a vertical direction, and $0<\alpha<45°$.

2. The headphone set according to claim 1, wherein the ear pad in included in the speaker housing and substantially wraps an ear of the user.

3. The headphone set according to claim 1, wherein the speaker housing has a restriction on a wearable direction.

4. The headphone set according to claim 2, wherein the ear pad is made of a material capable of suppressing an amount of leakage of a sound output from the speaker unit to the outside of the speaker housing.

5. The headphone set according to claim 1, wherein the connecting portion is connected to the speaker housing in a state where the speaker housing is movable approximately linearly such that a position of the connecting portion is relatively raised with movement in the forward direction of the user, and is relatively lowered with movement in the rearward direction of the user.

6. The headphone set according to claim 1, wherein the connecting portion further includes a rotary shaft which rotates the speaker housing, and movement of the connecting portion in the forward and rearward direction is accompanied with feeling of resistance harder than feeling of resistance in the rotation of the speaker housing by the rotary shaft.

7. The headphone set according to claim 1, wherein the connecting portion and the speaker housing respectively have scales.

* * * * *